United States Patent [19]

Geesen

[11] 4,408,895

[45] Oct. 11, 1983

[54] APPARATUS FOR ACCURATELY TIMING AN EVENT RELATIVE TO CLOCK SIGNALS

[75] Inventor: Michel Geesen, Antony, France

[73] Assignee: Electronique Marcel Dassault, Paris, France

[21] Appl. No.: 315,606

[22] Filed: Oct. 30, 1981

[30] Foreign Application Priority Data

Oct. 31, 1980 [FR] France ..... 80 23404

[51] Int. Cl.[3] ..... G04F 8/00

[52] U.S. Cl. ..... 368/118

[58] Field of Search ..... 368/117–120; 324/102–103, 140, 78; 328/110; 235/92 T

[56] References Cited

U.S. PATENT DOCUMENTS

| | | | |
|---|---|---|---|
| 3,983,481 | 9/1978 | Nutt et al. | 368/118 |
| 4,104,590 | 8/1978 | Zheunerov | 368/118 |
| 4,339,712 | 7/1982 | Walters | 324/102 |
| 4,362,394 | 12/1982 | Menlove | 368/118 |

OTHER PUBLICATIONS

"Nuclear Instruments and Methods", vol. 109, No. 3, 6/15/73, R. E. H. Jones et al., pp. 461–477.

*Primary Examiner*—Vit W. Miska

*Attorney, Agent, or Firm*—Pollock, Vande Sande & Priddy

[57] ABSTRACT

The apparatus gives an indication of the location in time between two successive clock signals of an event to be timed. Such an event may be the arrival of a laser pulse at a satellite. An integrator circuit (C84) is charged by a relatively high charging current from a first current generator (66) during the period of time between the event and the next clock signal. The integrator circuit is then discharged by a smaller current of opposite sign from a second current generator (80). The ratio of the charge and discharge currents "stretches" the inter clock pulse time interval to a length that can be measured by counting clock pulses as the integrator discharges. For this factor to be useful, it is essential that the charging current remains constant during charging and from one charging occasion to the next. This is achieved by keeping the generator (66) generating current constantly and by diverting the current through an integrator circuit by-pass (R78) when not integrating. Switching is done using two transistors (Q71 and Q72) that are as identical as possible, and independently controlled in phase opposition. The by-pass current is detected and used to regulate the generator (66). Provided both transistors deviate in the same manner from nominal characteristics, this provides accurate compensation for variations in the other transistor also.

11 Claims, 6 Drawing Figures

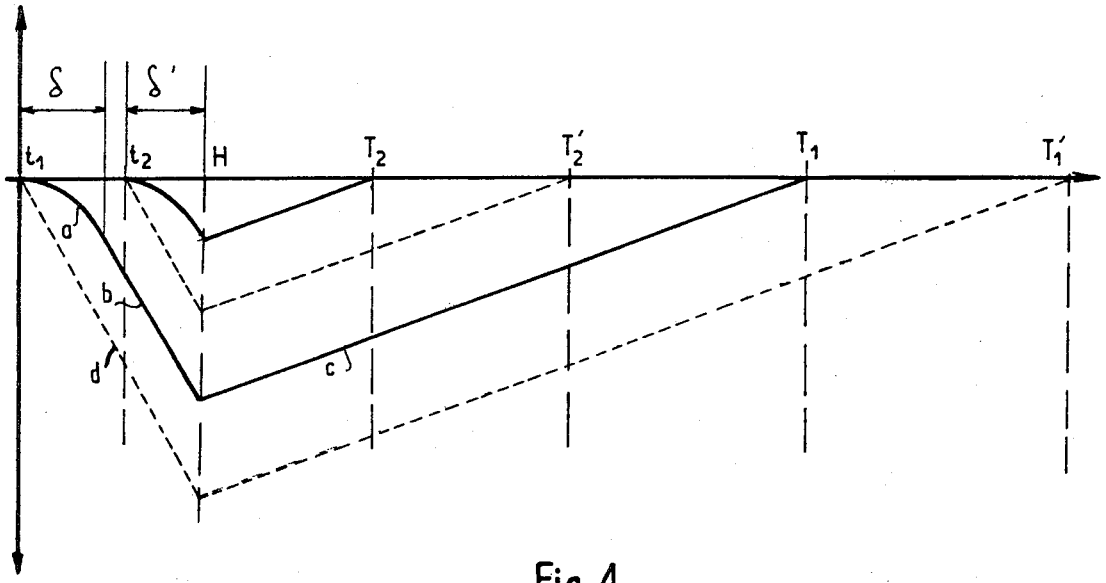
Fig.4
Fig. 5
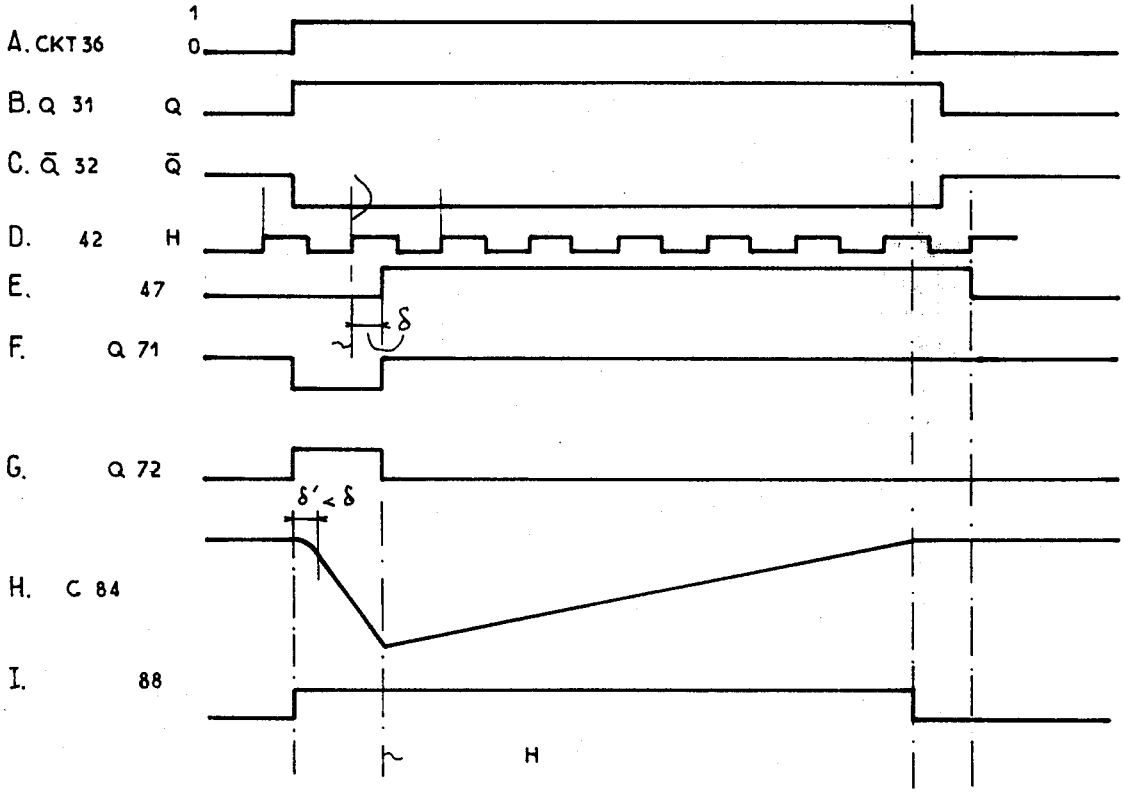

APPARATUS FOR ACCURATELY TIMING AN EVENT RELATIVE TO CLOCK SIGNALS

BACKGROUND OF THE INVENTION

The invention relates to apparatus for timing an event relative to clock signals, and in particular an event represented by the arrival of the front or leading edge of a pulse at a location provided with a clock.

To synchronize two or more clocks at different points on the surface of the Earth, e.g. atomic clocks, without moving the clocks, there has been a proposal to transmit one or more laser pulses from each site to a common target placed so that it can "see" at least two of the sites at the same time. Laser pulses can be transmitted at instants which are very precisely known relative to the clock on the transmitter site, and the time interval between the arrivals of laser pulses from two different clocks can be measured. The target is advantageously an Earth satellite.

The time interval is measured by timing the arrivals of the respective laser pulses at the satellite using an on board clock, and in determining the difference between said arrival times. The difference may be determined on the ground on the basis of data transmitted from the satellite concerning the respective arrival times.

In this application, the timing must be exceptionally accurate: to within better than one nanosecond.

Preferred embodiments of the present invention may be carried on board a satellite and used to time events such as the arrival of a laser pulse at the satellite to within better than one nanosecond.

SUMMARY OF THE INVENTION

The present invention provides apparatus for timing an event relative to a time reference provided by clock signals, the apparatus comprising:

an integrator circuit;

means for providing a charge signal and a discharge signal to said integrator circuit with respective signal amplitudes such that the charge rate is high relative to the discharge rate;

control means for applying the charge signal to the integrator circuit in response to a pulse representing the position in time of the event to be timed, and to stop applying the charge signal to said integrator in response to the next clock signal following said pulse and initiate the discharge thereof;

a detector to detect when said integrator circuit has discharged to a predetermined level; and a device for measuring the time that elapses between the beginning of discharge and the detection of said predetermined discharge level;

said means for providing the charge signal comprising means for causing a first predetermined current to pass through a by-pass circuit independent of the integrator circuit, and first and second switching devices of substantially identical electrical characteristics connected respectively to said by-pass circuit and to said integrator circuit and independently controlled by said control means in phase opposition to each other to stop said first current passing through said by-pass circuit and to cause it to pass through said integrator circuit in a substantially instantaneous manner in response to the arrival of a pulse representing the event to be timed, and vice-versa in response to said clock pulse that stops charging.

Thus, in accordance with the invention, it is possible to obtain extremely accurate switching at the beginning of integrator charging with minimal transient phenomena. In particular, transients are reduced firstly by ensuring that said first current is already stabilized at a predetermined level in the circuit by-passing the integrator circuit, and then by diverting said stabilized first current to the integrator circuit. Further, by applying a completely symmetrical set of control signals to the switching devices used for this purpose, switching delays in changing over between the by-pass circuit and the integrator circuit are avoided both at the beginning and at the end of the charging period. Each of the switching devices is preferably switched as hard as possible from a fully off condition in which leakage current is reduced to a minimum, and a fully on condition in which the switching devices have little effect on the magnitude of said first current. These precautions are particularly useful for satellite equipment that has to operate for long periods of time without human intervention being possible, and which is subject to large temperature variations.

In accordance with an embodiment of the invention, the charge signal is composed by superposing the first predetermined current and the discharge current which is of much smaller magnitude and opposite sign, and which is thus also applied to the integrator circuit from the beginning of charging. At the end of charging, only the first predetermined current is switched to pass through the by-pass circuit, while the discharge current remains applied to the integrator circuit at least until the end of its discharge period. The discharge current may be controlled outside the charge and discharge periods by means of a switching circuit which applies a short circuit across the terminals of the integrator circuit via which short circuit the discharge signal flows when the integrator circuit is not in use.

Advantageously, the first predetermined current is regulated to maintain a constant current flowing through the first switch device connected to the by-pass circuit, thereby compensating for variations in the electrical characteristics of the switch device. In so far as these variations are substantially identical to variations in the second switch device whose characteristics are chosen to be as close as possible to those of the first, the current flowing through the second switch device during its short periods of operation is thereby regulated indirectly.

In accordance with an advantageous embodiment of the switching control, a delay circuit is provided to delay the instant at which charging is stopped (and consequently discharging begins) in the integrator circuit for a length of time which is at least equal to the time required by the integrator circuit to begin charging linearly after receiving the pulse representing the event to be timed.

This embodiment is of particular interest when a time interval between two events is to be measured. In such a case, any non-linearity defects at the beginning of a capacitor's charging characteristic have no effect on the accuracy of the measurement, provided the integrator is not stopped from charging until it has reached a state where it is charging linearly.

The time it takes the integrator circuit to discharge provides a measure of the time interval between the arrival of the event to be timed and the immediately following clock pulse. Advantageously, this discharge period is itself timed by counter means that count pulses of the reference clock used to time the event. The discharge time is preferably timed by letting the counter count continuously, and by reading the instantaneous state of the counter means at the beginning and the end of the discharge period in response to corresponding signals.

The invention is advantageously used to time the arrival of laser pulses received by a satellite, for the purpose of synchronising atomic clocks situated at distinct ground sites.

BRIEF DESCRIPTION OF THE DRAWINGS

An embodiment of the invention is described by way of example with reference to the accompanying drawings, in which:

FIG. 4 is a timing diagram illustrating the charging and discharging curves of an integrator circuit used for timing a laser pulse;

FIG. 5 is a waveform diagram of various signals appearing in the circuit of FIG. 2.

DESCRIPTION OF PREFERRED EMBODIMENT

Figure 1:
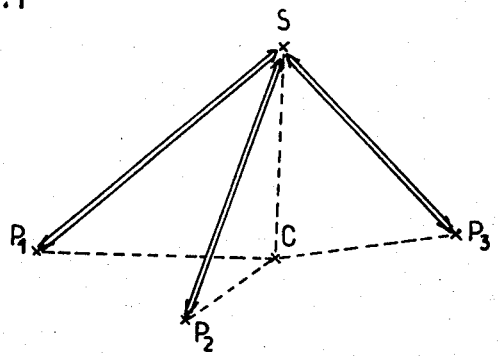
FIG. 1 is a diagram representing a satellite in communication with three ground stations.

A satellite S (FIG. 1), which may be spin stabilized for example, includes optical apparatus 21 (FIG. 2) suitable for projecting a laser beam onto a photoelectric converter 22. The laser beam may come from one or more stations from a plurality of stations P1, P2, P3, . . . , each of which is equipped with a clock, e.g. an atomic clock. In this example, the purpose of the installation is to synchronize said clocks by measuring the time intervals which separate the arrival times of laser pulses from different clocks, thereby making it possible to determine the degree by which the clocks are out of synchronization.

The converter 22 may comprise a single photodiode or other photoelectric cell, as shown, or it may comprise a plurality of photodiodes, each attributed to one of the wavelengths used by one or more of the transmitting stations.

Each station Pn transmits a laser pulse in a time slot attributed thereto, and advantageously it has a multiplicity of time slots attributed thereto, e.g. a hundred of them, so that the final measurement is based on the average of a large number of measurements.

Laser pulse transmission instants are timed at each of the stations by the local atomic clock, while the satellite installation has the purpose of timing the arrivals of laser pulses transmitted by different stations in order to determine the time intervals between said arrivals. This makes it possible to adjust the atomic clocks at one or more of the stations to bring them into more exact synchronisation, or simply to obtain more information on the time shift between the clocks. For this purpose, information concerning the arrival time of each laser pulse as measured against the clock available in the satellite is sent by a telemetry link to each of the stations, or preferably, to a central station C which has telemetry links not only to the satellite, but also to the various other stations.

The optical apparatus 21 includes a reflector to reflect the laser beam back to each transmitting station. Each station, e.g. the station P1, can then measure the time between transmitting and receiving the echo to obtain the round-trip time for laser pulses between that particular station and the satellite.

In addition to the reflector (not shown), the optical apparatus 21 includes means for directing laser energy reaching the satellite onto a photodiode 22 via an optical system, e.g. a lens (not shown).

The electrical output from the photodiode 22 is connected via an amplifier-detector 25 to the CE input CE27 of a first D-type bistable 28 which has its D input D29 permanently connected to a fixed potential equivalent to logic level 1. The bistable 28 has a reset to zero input R30, and direct and inverting outputs Q31 and $\overline{Q}$32 respectively. The Q output Q31 of the bistable 28 is connected to a control input 35 of a switching circuit 36, and via a link 33, to the D input D40 of a second D-type bistable 41.

In a first condition, the switching circuit 36 short circuits two terminals 37 and 38, and in a second condition, it removes the short circuit from between said terminals.

The second bistable 41 has its clock input CE42 connected to receive output signals from an amplifier 43 which receives clock signals on its input from a clock circuit 44, operating in the present example at a frequency chosen to be 15 MHz. The second bistable 41 has a Q output Q45 connected via a delay circuit 46 (which may be constituted by two logic gates connected in series) to one input 46 of an OR gate 48 whose other input 49 is connected to the inverted output $\overline{Q}$32 of the first bistable 28. The output from the delay circuit 46 is also connected via a link 51 to an interface circuit 50 to transmit a "start conversion" signal thereto. Depending on the internal delay inherent to the interface circuit 50, the link 51 may alternatively be connected to the upstream side of the delay circuit 46. A link 53 goes from the interface circuit 50 to reset the first bistable 28 to zero via its input R30. The interface circuit 50 also receives inverted clock pulses via an input 54 from an inverting output of the amplifier 43. The interface circuit 50 has other connections which are explained further on.

The OR gate 48 has a direct output 58 and an inverting output 60. The direct output 58 is connected to the base 61 of a first NPN transistor Q71, while the inverting output 60 is connected to the base 62 of a second NPN transistor Q72. The first and second transistors Q71 and Q72 are chosen to have substantially identical characteristics, and their emitters are connected together to one terminal 65 of a regulatable constant current generator 66 which supplies a current hereafter referred to as I. The end 67 of the generator 66 opposite to the terminal 65 is connected to a power supply which is at −15 volts in the present example. The nominal current of the generator is 20 milliamps in this example. The current generator 66 has an input 68 on which it receives a voltage signal from a comparator circuit 70 for the purpose of regulating the current I in a manner described below. The comparator circuit 70 has a first input input 73 on which it receives a voltage signal taken from the collector 75 of the first transistor Q71, and a second input 74 on which it receives a zener-stabilized reference voltage on the basis of which the magnitude of the current I is regulated.

The collector 75 of the first transistor Q71 is connected to ground or electric reference voltage M by a resistor R78. The terminal 37 of the switching circuit 36 is directly connected to ground M. The collector 76 of the second transistor Q72 is directly connected to the other terminal 38 of the switching circuit 36, and also to one end of a second constant current generator 80 whose other end is connected to a power supply at +12 volts, for example. The second constant current generator delivers a current referred to hereafter as i, where i is chosen to be about 20 microamps, i.e. about one thousandth of the current I. A capacitor C84 is connected between the terminals 37 and 38 with a first plate 85 connected to the terminal 37 and hence to ground potential, and with its second plate 86 connected to the terminal 38. The second plate 86 is also connected to the inverting input 120 of a voltage comparator 88 whose non-inverting input 121 is grounded and whose output 90 is connected both to an "end of conversion" line 92 for indicating that the capacitor C84 has finished discharging, and (via a line 94) to a second control input 95 of the switching circuit 36 to cause it to reconnect its terminals 37 and 38 to each other as soon as a signal appears on the output 90 of the comparator 88. The comparator 88 thus acts as voltage level detector responsive to the voltage on the plate 86 of the capacitor C84.

Figure 6:
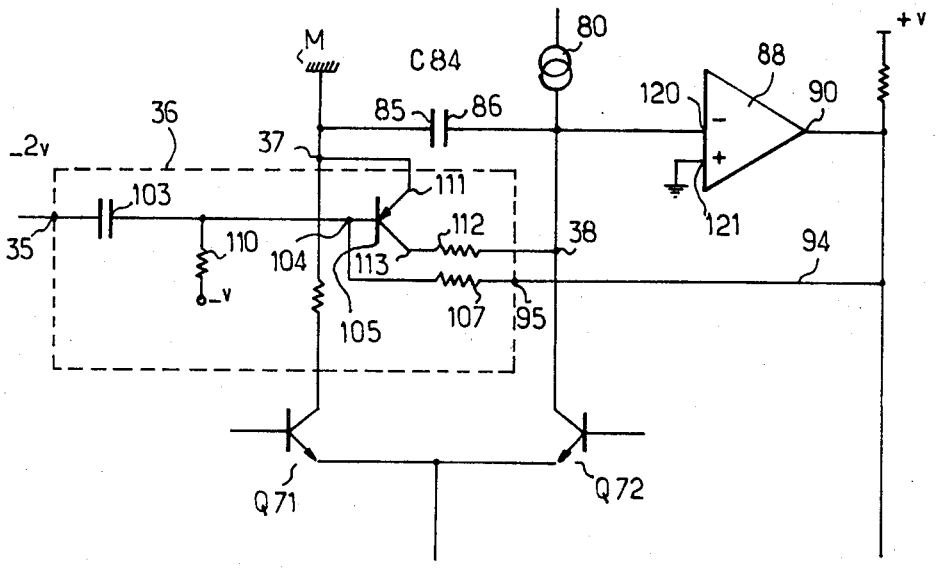
FIG. 6 is a detailed circuit diagram of a part of the circuit shown in FIG. 2.

FIG. 6 shows the switching circuit 36 in greater detail. Its control input 35 is connected to one plate of a capacitor 103 whose other plate is connected to the base 104 of a PNP transistor 105. The base 104 is also connected to the other control input 95 of the switching circuit 36 via a resistor 107. The emitter 111 of the transistor 105 is directly connected to the grounded terminal 37 of the switching circuit, while the collector 113 of the transistor 105 is connected to the other terminal 38 via a resistor 112. A bias resistor 110 connects the base 104 to a negative bias potential (−v).

The bias circuit constituted by the resistor 110 and the resistor 107 is arranged to ensure that the transistor 105 is conductive when the comparator 88 is at rest, thereby putting a short circuit across the capacitor C84, leaving only a residual potential across its plates 85 and 86 due to the voltage drop caused by the current i passing through the resistor 112. This drop is always greater than the offset voltage of the comparator 88 in order to ensure that the comparator switches over hard when a capacitor charge signal is applied to its inverting input 120.

The general operating principle is as follows:

As soon as a laser pulse arrives, the capacitor C84 begins charging at a stable and relatively high rate. Charging is stopped on the arrival of the next signal from the on-board reference clock 44 to arrive after the laser pulse. From that moment the capacitor C84 is discharged at a known rate that is about one thousandth of the charging rate, and the time taken to discharge the capacitor is measured. The clock 44 is used to measure this time interval, in a manner described below. The end of discharging is detected by the comparator circuit 88 which generates an end of conversion signal which is timed in order to measure the time interval.

Figure 2:
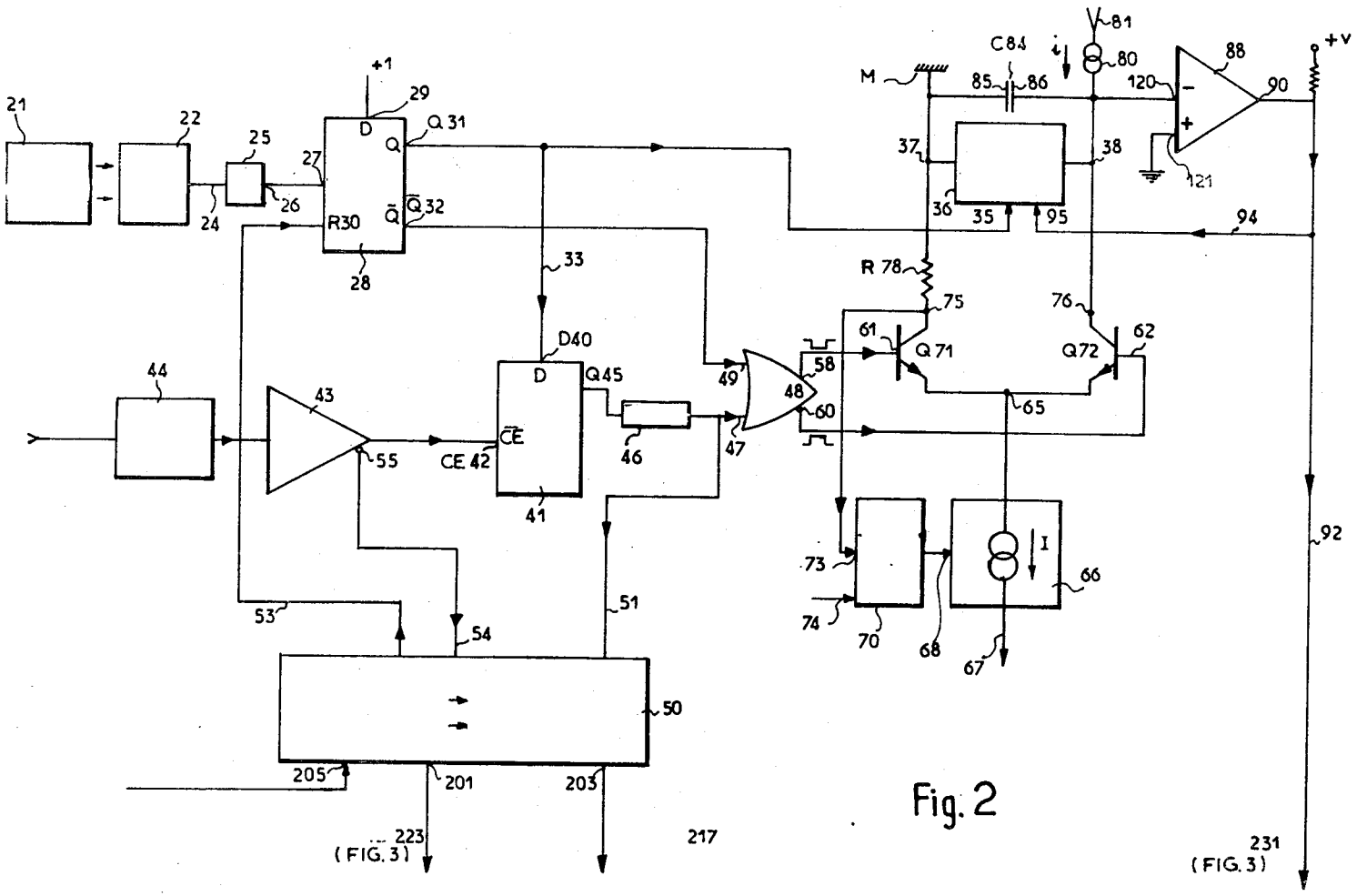
FIG. 2 is a synoptic circuit diagram of a circuit for measuring the position of a laser pulse relative to a reference clock.

Detailed operation can be followed by looking at FIG. 2 in conjunction with the waveform diagrams of FIG. 5.

Before a laser pulse is received, the switching circuit 36 is in its on position (level 0 in waveform A of FIG. 5). The Q output Q31 is at level 0, while the $\overline{Q}$ output $\overline{Q}$32 is at level 1 (waveforms B and C). The clock 44 produces a square wave H, as shown in waveform D, which is applied to the clock input CE42 of the second bistable 41. The Q output Q45 of the bistable 42 is at level 0. The base 61 of transistor Q71 is powered from the $\overline{Q}$ output $\overline{Q}$32 of the first bistable 28 via OR gate 48, thereby keeping transistor Q71 in the conductive state (waveform F). The base 62 of transistor Q72 is not powered so transistor Q72 is off (waveform G). Capacitor C84 is discharged, with its plates being short-circuited by the switching circuit 36 (waveform H).

The arrival of a laser pulse at the photodiode 22 results in an electric pulse appearing on output 24 thereof, whose leading edge or front, is amplified and applied to the clock input CE27 of the first bistable 28 causing its Q output Q31 to switch to level 1, thereby making the switching circuit 36 go open circuit to remove the short across its terminals 37 and 38. Simultaneously, the $\overline{Q}$ output $\overline{Q}$32 changes to level 0, thereby cutting off the power to the base 61 of the first transistor Q71, which consequently turns off, and applying power, via the inverting output 60 of the OR gate 48, to the base 62 of the second transistor Q72 which consequently turns on. Terminal 38 of the switching circuit 36 is thus connected to the constant current generator 66, whereby the capacitor C84 which is no longer short circuited begins to charge negatively (waveform H) under the effect of a current equal to I−i, (ignoring for the moment the base-emitter current of the second transistor Q72).

The detailed operation of the switching circuit 36 is as follows: the output signal Q31 (FIG. 6) charges the capacitor 103 to a level which causes the transistor 105 to turn off. Then, under the effect of the charge on the capacitor C84, the voltage level at the output of the comparator 88 rises and re-inforces the off bias to the base 104 via the second control input 95.

At the same time as the outputs Q31 and $\overline{Q}$32 of the first bistable 28 change state, the D input D40 of the second bistable 41 is brought to level 1. The second bistable is thus made ready to change state on the arrival of the next leading edge in the clock signal from the clock circuit 44. This edge or front is designated FA in waveform D. It causes the state of the output Q45 to change state, and this change of state is passed through the delay circuit 46. (This circuit may simply comprise two logic gates connected in series, since only a short delay is required, so long as it is long enough to perform the function explained below.) At the end of this delay designated δ in waveform E, a signal appears on input 47 to the OR gate 48 which returns its outputs 58 and 60 to their initial conditions thereby turning off the second transistor Q72, and turning back on the first transistor Q71. Whereupon the capacitor C84 begins to discharge under the effect of the current i while the larger current I is diverted by the transistor Q71. The discharge is represented in waveform H by the line of small positive gradient which, in fact, should be about one thousandth the magnitude of the preceding negative charging gradient. The time taken to discharge is timed by means that are explained below.

At the end of discharging, the plate 86 of the capacitor C84 returns to about zero potential and causes a drop in the voltage at the output 90 of the comparator 88. This brings down the voltage at the base 104 of the transistor 105 to allow enough current to pass to prevent the capacitor C84 from charging appreciably to an unwanted level in the opposite direction under the effect of the current i.

The voltage drop at the output 90 of the comparator 88 (end of conversion signal) causes timing information to be stored in a memory described below, and once this has been done, the first bistable 28 is reset to zero causing its outputs Q31 and $\overline{Q}$32 to change state whereby the capacitor C84 is returned to its rest position, and causing the second bistable 41 to have its Q output Q45 returned to its rest position when the next clock pulse arrives. The capacitor C84 is returned to its rest position when the output Q31 returns to its initial state which brings the bias on the base 104 of the transistor 105 to a level where the transistor is returned to the fully conductive state (FIG. 6).

Supposing the frequency of the satellite clock is 15 MHz, it will be understood that the period between two leading edges in the clock signal is long compared with the accuracy required to time the arrivals of the abovementioned laser pulses (accuracy to within one nanosecond). The circuit which has just been described makes it possible to localise the arrival time of such a pulse in between two successive leading edges (such as FA in waveform D) in the clock waveform by measuring the time taken by the capacitor to discharge. This time is long relative to the clock frequency and may be measured by counting clock pulses. For example, if the capacitor discharges at one thousandth the rate at which it charges, the level of charge reached by integrating over the entire period between two successive clock pulses, will take a period of one thousand pulses of the same clock to discharge. If the discharge period is timed at 600 clock pulses, for example, it can be deduced that the laser pulse arrived sixty percent (60%) of a clock period early relative to the clock pulse which started the discharge (ignoring a constant error due to the delay $\delta$).

The real charging curve of the capacitor C84 after the arrival of a laser pulse at time $t_1$ is shown as a solid line in FIG. 4. It has an initial portion a which is non-linear, followed by a linear portion b. Charging continues until the instant H at which the delayed clock pulse arrives at the input 47 of the OR gate 48. The transistor Q72 then turns off, the transistor Q71 turns on, and the capacitor C84 discharges linearly.

The theoretical charging curve of the capacitor C84 after the arrival of the laser pulse at time $t_1$ is shown by a dashed straight line d in FIG. 4. The real and theoretical charging and discharging curves are also shown for a laser pulse arriving at time $t_2$. The end of conversion signals are provided at times $T_1$ and $T_2$ respectively for the real curves (solid lines) and the $T'_1$ and $T'_2$ for the theoretical curves (dashed lines). It will be observed that $T_1-T_2=T'_1-T'_2$, thus, since the laser pulses are timed by taking a difference, the timing information obtained corresponds to the actual timing information sought, provided that the linear portion b of the charging curve is always reached before discharge begins.

The function of the delay circuit 46 in FIG. 2 is to delay application of the next clock pulse to the input 47 of OR gate 48 by a period $\delta$ which is at least equal to the time $\delta'$ necessary for the capacitor C84 to reach the linear portion of its charging curve. The instant H at which the transistors Q71 and Q72 switch over to start discharging the capacitor C84 is thus always at least $\delta$ after the arrival of the laser pulse, where the delay $\delta$ may be one tenth of the period of the clock 44, for example. This prevents discharge from starting from a non-linear point in the charging curve of capacitor C84. Thus, if a laser pulse arrives very soon after a leading edge in the clock signal, it is possible that the capacitor will be charged for slightly longer than one clock period. Under these conditions, the number of pulses counted during the discharge period of the capacitor C84 will be slightly larger than K, where K is the dilation factor by which time is "stretched" by the technique of using different charging and discharging rates.

This arrangement makes it possible to use a satellite clock of relatively low frequency, say about ten to twenty MHz, and yet obtain timing errors of less than one nanosecond, and possibly down to a few tens of picoseconds. The power consumption of the satellite equipment remains low, as does its weight. Various techniques are preferably applied to ensure that the maximum possible benefit in terms of accuracy can be drawn from the circut described.

It is most important that the charging current should be constant to a very high degree, since a very small variation in charging current can lead to considerable differences in the time measured on the "stretched" time scale. Great care is therefore taken to match the characteristics of the first and second transistors Q71 and Q72 as closely as possible to each other.

Further, as indicated above, the charging current applied to the capacitor C84 is not exactly equal to the difference I−i of the currents from the constant current generators 66 and 80, but to the difference between the collector current (point 76) of the transistor Q72 and the current i. The collector current is itself equal to the difference between the current I and the base-emitter current of the transistor Q72. Since the base-emitter current of the transistor may vary, the current I is regulated, and given that the second transistor Q72 is turned on for short periods only, the regulation is done on the basis of the collector current flowing through the first transistor Q71. Thus, while the first transistor Q71 is conducting, its collector voltage (the voltage at point 75) is applied to the comparator 70 and compared with a reference voltage applied to input 74 to the comparator. The current generator is regulated as a function of the error signal which appears at the output of the comparator 70. The collector voltage signal is representative of the collector current flowing through the resistor R78. Since the transistors Q71 and Q72 are very similar to each other, both concerning their characteristics and their environment, it is possible, when regulating the current I, to use the variations in base-emitter current of one of them as a guide to within a very small error of the variatons in the base-emitter current of the other. When the transistor Q72 begins conducting, its collector current (which together with the current i determines the the charging current of the capacitor C84) is thus well maintained at a constant value with a degree of accuracy that depends essentially on the accuracy of the zener voltage on the input 74 of the comparator 70.

The interface circuit 50 shown in FIG. 2 has the function of converting or matching the signals produced or received by the circuits shown, which use ECL technology, to levels suitable for TTL or C.MOS logic from which the rest of the timing and data processing equipment on board the satelite is made. Thus a reset to zero signal RAZ is applied to the input 205 of the interface 50, and this serves to reset the first bistable 28 via the link 53. An output 201 from the interface 50 supplies clock signals at the frequency of the signals present on the link 54. An output 203 transmits a beginning of conversion signal to the outside as soon as such a signal appears on link 51. Finally, link 92 connected to the output of the comparator 88 transmits an end of conversion signal as explained above.

Figure 3:
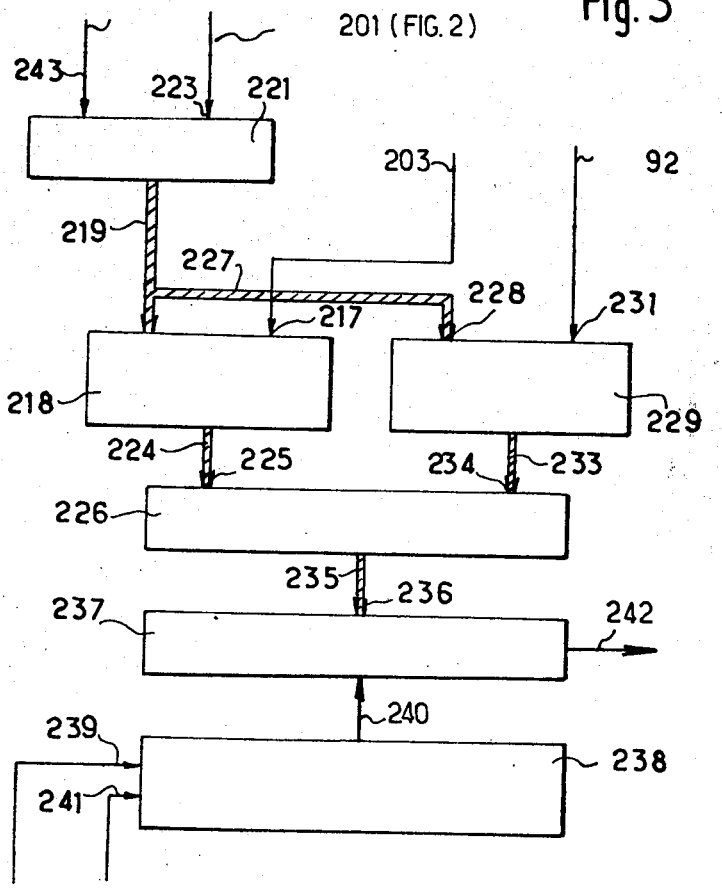
FIG. 3 is a block diagram of a timing circuit used downstream from the circuit shown in FIG. 2.

Reference is now made to FIG. 3. The measuring circuit shown in this figure is intended to time the discharging of the capacitor C84 under the effect of the discharge current i.

A counter 221 counts clock pulses received on its input 223 from the output 201 of the interface 50 at the frequency of the pulses being applied to the input of the second bistable 41. This counter runs freely, i.e. it counts continuously from an initial value until it reaches its maximum count and then it starts counting again from its initial value and so on, and this continues for as long as it is supplied with clock pulses. It is connected by a multi-bit connection 219 to two registers 218 and 229. The register 218 has a control input 217 connected to the output 203 from the interface 50 whereby the register 218 is loaded with the contents of the counter 221 at the moment the beginning of conversion pulse appears on the output 203 of the interface 50. The register 229 is suitable for loading the less significant stages of the counter 221 (e.g. the 12 least significant binary stages) when its input 231 receives the end of conversion signal from link 92 of FIG. 2. This second register 229 thus stores the instantaneous state of the less significant stages of the counter 221 at the moment the end of discharge is detected.

The outputs from the registers 218 and 229 are connected to respective inputs 225 and 234 of a write device which enters the contents of the registers into a memory 237 via a multibit link 235 connecting the output of the write device to the input 236 of the memory 237. The memory 237 is asociated with a read device 238 which sends stored information out serially over an output 242 under the control of a control link 240. The read device 238 has two inputs: a rate input 241 and a transfer enable input 239 to control bit-by-bit transfer of information in the memory 237 over the output 242.

In the satellite application envisaged, the bits from the serial output 242 are transmitted by telemetry to a ground station that has the task of centralizing the information necessary for synchronizing the clocks.

The very high accuracy of the timing circuit which has just been described makes it possible, when measuring the time between the arrival of a laser pulse and the following clock pulse, to take advantage of time dilation factors that are greater than 500 and may be more than one thousand. It would be pointless to use such a large time dilatation factor (which is easily established by setting the ratio of the charging and discharging currents) without the very high accuracy obtained in the switching operations required for measuring the pulse arrival times, which accuracy is obtained by the various measures described above.

I claim:

1. Apparatus for timing an event relative to a time reference provided by clock signals, the apparatus comprising:

an integrator circuit;

integrator signal providing means for providing a charge signal and a discharge signal to said integrator circuit with respective signal amplitudes such that the charge rate is high relative to the discharge rate;

control means for causing the charge signal to be applied to the integrator circuit in response to an event pulse representing the position in time of the event to be timed, and to halt the application of the charge signal to said integrator in response to a clock signal following said pulse and for causing the integrator circuit to begin discharging;

a detector to detect when said integrator circuit has discharged to a predetermined discharge level; and time measuring means for measuring the time that elapses between the beginning of discharge and the detection of said predetermined discharge level;

said means for providing the charge signal comprising first current producing means for causing a first current to pass through a by-pass circuit independent of the integrator circuit, and switching means to divert said first current from the by-pass circuit to the integrator circuit in response to said event pulse;

said switching means comprising first and second substantially identical switching devices connected respectively to said by-pass circuit and to said integrator circuit and independently controlled by said control means in phase opposition to each other to simultaneously halt said first current passing through said by-pass circuit and to cause it to pass through said integrator circuit in response to said event pulse, and vice-versa in response to said following clock signal.

2. Apparatus according to claim 1, wherein said first current producing means comprise a current generator connected to a point common to said integrator circuit and to said by-pass circuit upstream from said switching devices.

3. Apparatus according to claim 2, including means for detecting the level of said first current as it passes through the by-pass circuit downstream from said first switching device, and wherein the current generator is controllable and is connected to be regulated by said detecting means in such a manner as to maintain the level of said first current downstream from either of said switching devices stable in spite of possible variations in the electrical characteristics of said switching devices.

4. Apparatus according to claim 1, wherein said first and second switching devices are respectively constituted by first and second transistors with their emitters connected in common to receive said first current, and with their bases connected to two respective outputs from said control means arranged to provide complementary logic signals as a function of said event pulse and said following clock signal.

5. Apparatus according to claim 1, wherein said control means are connected to cause said integrator circuit to discharge as soon as the charging signal is halted.

6. Apparatus according to claim 5, wherein said integrator signal providing means include a discharge current generator and wherein said control means are connected to apply the discharge current to the integrator circuit in opposition to said first current from the beginning of charging, whereby said charging signal is substantially equal to the difference between said first current and said discharge current, and to modify the application of the discharge current in response to the detection of said predetermined discharge level.

7. Apparatus according to claim 6, wherein said means for applying the discharge current include a discharge current switching circuit connected to short circuit the integrator circuit in a first switching position, and to apply the discharge current thereto in a second switching position.

8. Apparatus according to claim 1, wherein said control means further include a first bistable which is triggered in response to said event pulse, and a second bistable which is responsive to said event pulse to be enabled to respond to said following clock signal, said switching devices being controlled by said first and second bistables.

9. Apparatus according to claim 1, wherein said control means further include a delay circuit suitable for delaying the halting of the integrator circuit charging current for a length of time at least equal to the time taken by the integrator circuit to begin charging linearly.

10. Apparatus according to claim 1, wherein said time measuring means include counter means connected to count pulses in said reference clock signal.

11. Apparatus according to claim 10, further including means for reading the instantaneous state of said counter means at the beginning and at the end of the integrator discharge period without interfering with said counter means' counting of said clock pulses.

* * * * *